United States Patent [19]

Akazawa

[11] 4,173,183

[45] Nov. 6, 1979

[54] LINE PRINTER CHARACTER BELT

[75] Inventor: Hiroyuki Akazawa, Shiojiri, Japan

[73] Assignees: Kabushiki Kaisha Suwa Seikosha, Tokyo; Shinshu Seiki Kabushiki Kaisha, Nagano, both of Japan

[21] Appl. No.: 885,416

[22] Filed: Mar. 10, 1978

Related U.S. Application Data

[63] Continuation-in-part of Ser. No. 758,885, Jan. 12, 1977, abandoned.

[30] Foreign Application Priority Data

Jan. 16, 1976 [JP] Japan ..... 51-4347

[51] Int. Cl.[2] ..... B41J 1/20

[52] U.S. Cl. ..... 101/111; 101/93.14; 101/93.02

[58] Field of Search ..... 101/93.02, 93.13, 93.14, 101/111

[56] References Cited

U.S. PATENT DOCUMENTS

| | | | |
|---|---|---|---|
| 3,638,565 | 2/1972 | Drejza et al. | 101/93.14 |
| 3,805,941 | 4/1974 | Cattaneo | 101/111 X |
| 3,845,711 | 11/1974 | Holms | 101/93.14 X |
| 3,890,895 | 6/1975 | Deproux | 101/93.14 X |
| 3,968,744 | 7/1976 | Kasu et al. | 101/93.02 |
| 4,119,029 | 10/1978 | McMillan et al. | 101/93.14 X |
| 4,121,517 | 10/1978 | Dobson | 101/93.14 |

*Primary Examiner*—Edward M. Coven

*Attorney, Agent, or Firm*—Blum, Moscovitz, Friedman & Kaplan

[57] ABSTRACT

In a line printer character belt in which characters are mounted on flexible fingers which are struck by printing hammers toward a platen in the printing operation, the fingers are flexed toward the platen by a projection on the fingers or on a character block on which the fingers are mounted. Vibration subsequent to the printing operation is eliminated, thereby providing excellent printing quality free of dirt and ghosts.

5 Claims, 8 Drawing Figures

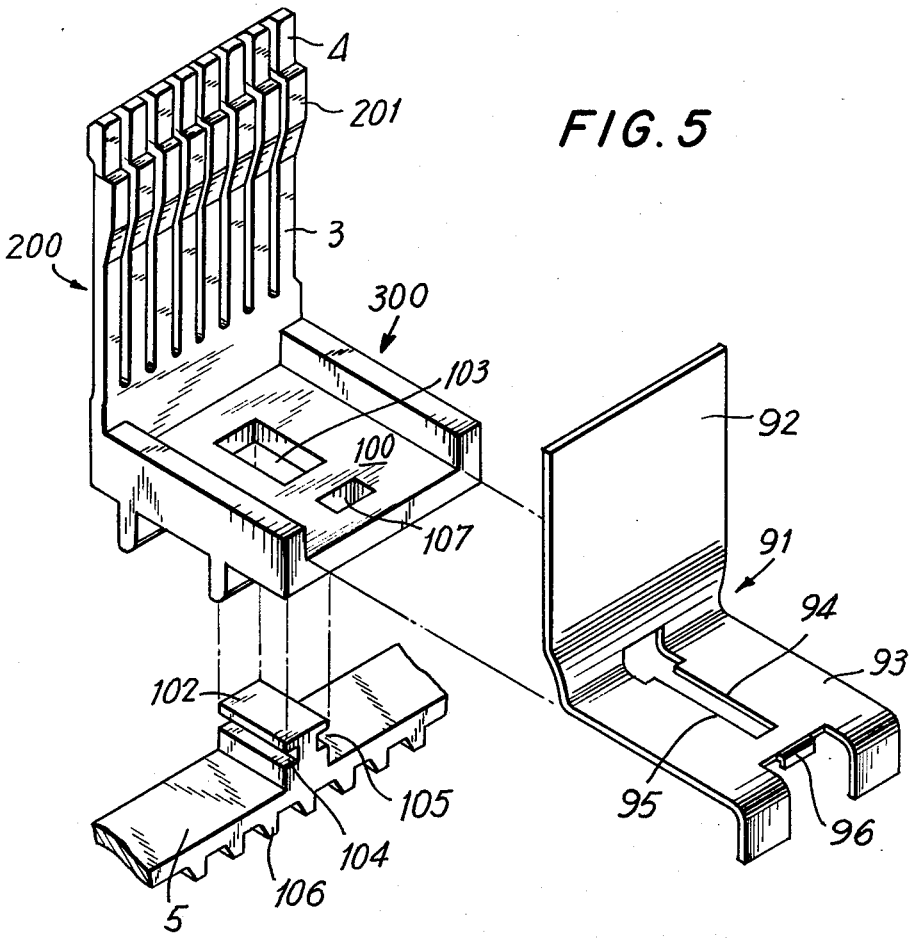
FIG. 5
FIG. 6a
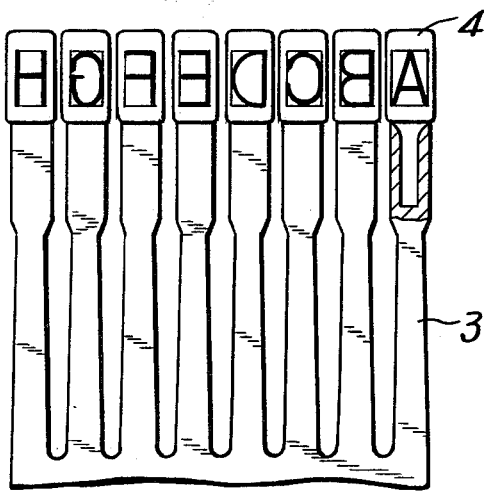
FIG. 6b
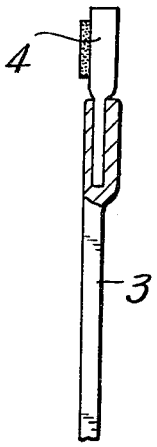

LINE PRINTER CHARACTER BELT

CROSS REFERENCE TO RELATED APPLICATION

This application is a continuation-in-part application of my co-pending application Ser. No. 758,885, filed Jan. 12, 1977, entitled LINE PRINTER CHARACTER BELT, and now abandoned.

BACKGROUND OF THE INVENTION

In a conventional character belt for use in a line printer where character blocks each carrying a plurality of fingers are mounted on the belt and characters are provided at the ends of the fingers, the character blocks are of such a shape that they are neither influenced by nor influence vibration of a finger subsequent to a printing operation. Consequently, when the finger is struck by a printing hammer, the finger undergoes vibration subsequent to striking the ribbon and paper against the platen. The fact that the character is at the end of the finger makes it unstable; resonance occurs so that the character may strike the ribbon and paper against the platen subsequent to the initial stroke. This phenomenon can result in so-called printing dirt and, the character may not stabilize even by the time it is next struck by a printing hammer. This type of operation may result in destruction of a finger as well as generation of printing ghosts.

As is evident, then, it would be highly desirable to provide a construction in which vibration due to the printing operation itself could be eliminated, thereby preventing both printing dirt and printing ghosts.

SUMMARY OF THE INVENTION

An endless belt carries character blocks detachably mounted thereon. To each character block is mounted a plurality of character fingers. Each finger is flexible and attached at one end thereof to the character block. The other end of the finger carries a character. Each character block has a projection thereon flexing each finger in a direction in which the finger is to move during the printing operation, the projection preferably being part of the finger. The finger is struck, in the printing operation, by a printing hammer. The projection is so positioned as to minimize vibration subsequent to striking the finger with a printing hammer. Further to this objective the projection may be made of a resilient material suitable for damping vibration. Appropriate materials are rubber and resilient plastics.

In a preferred embodiment the fingers are injection-molded integrally with the character block, the characters being of metal and being united with the character block during the molding process. An L-shaped retainer holds the block removably to the endless belt and biases the fingers toward the platen against which printing is to be effected.

Accordingly, an object of the present invention is an apparatus in which vibration of a character finger is minimized subsequent to a printing operation carried out with said character finger.

Another object of the present invention is an apparatus in which a projection on a character block carrying a flexible finger is positioned so as to minimize vibration subsequent to striking said flexible finger during a printing operation.

An important object of the present invention is a character block having a projection of a resilient material for damping vibration in a character finger subsequent to a printing operation.

A significant object of the present invention is an injection-molded character block in which the fingers holding characters and the metal characters on the fingers are integral with said block.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is an exploded view of a preferred embodiment of the present invention showing an injection-molded character block, a retainer for holding said block to an endless belt and a portion of said belt; and FIGS. 6*a* and 6*b* are, respectively front and side views of character fingers in partial section on said character belt.

DESCRIPTION OF THE PREFERRED EMBODIMENTS

Figure 1:
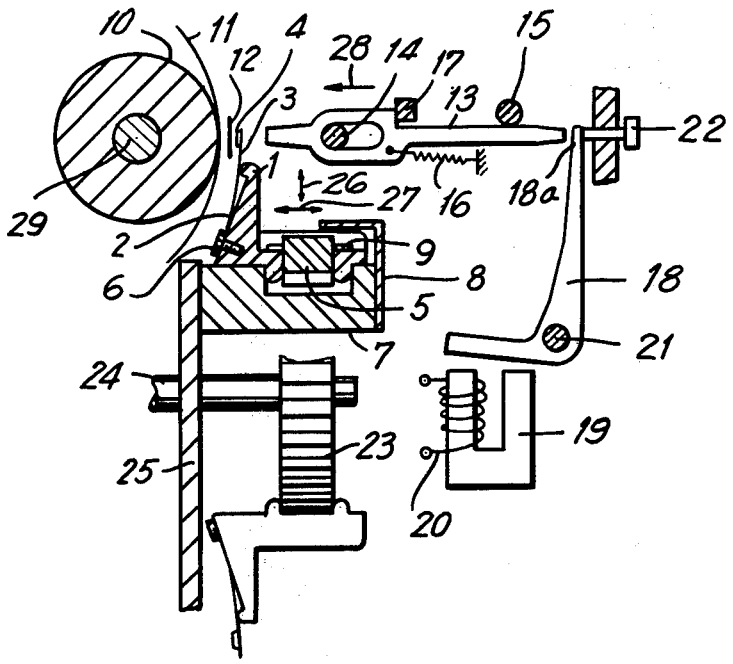
FIG. 1 is an elevational view in section of an apparatus in accordance with the present invention.
Figure 2A:
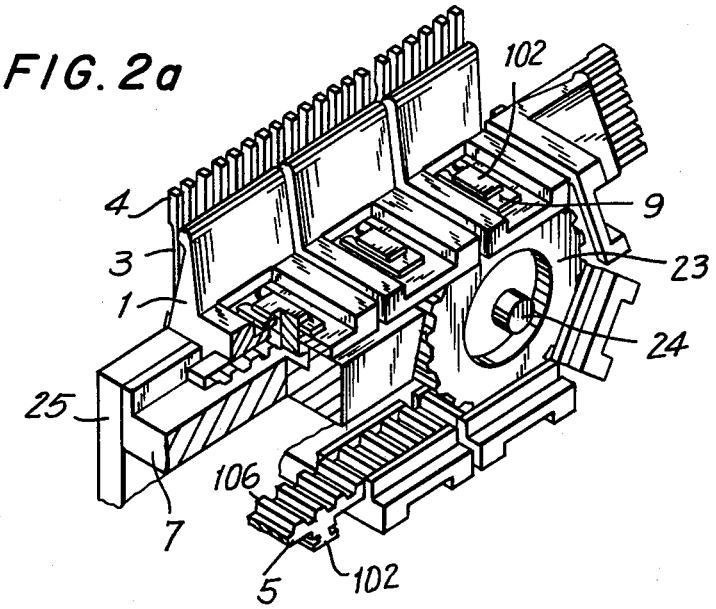
FIG. 2*a* is a perspective view, partially broken away, of an apparatus in accordance with the present invention.
Figure 2B:
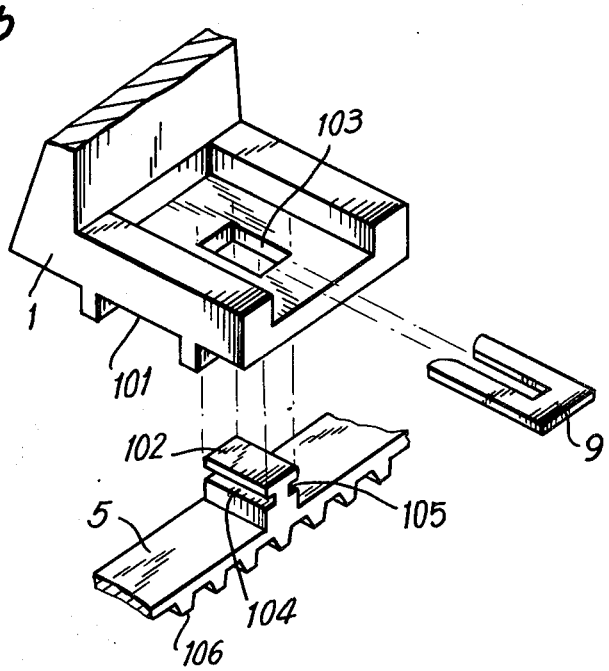
FIG. 2*b* is an exploded view of a character block in accordance with the present invention showing the method of attachment to a character belt.

FIG. 1 shows schematically a character holder 1 mounted on an endless character belt 5 the face of which runs in a direction parallel with a line to be printed. Character block 2 holds a plurality of fingers 3 of a flexible material, each of said fingers 3 having mounted proximate the end thereof a character 4. Each of the fingers 3 is secured at the lower end thereof to the character holder 1. Guide rails 7 and 8 are fitted to the character holders 1 so as to control the motion of the character holders in the directions indicated by arrows 26 and 27, thereby lining up characters 4 in relation to the line to be printed.

A plurality of printing hammers 13 are provided in positions such that they can be actuated in the direction indicated by the arrow 28. The motion of printing hammers 13 is controlled by guide rods 14 and 15, and the hammers are biased away from flexible fingers 3 by springs 16. When actuated, hammer 13 forces character 4 against ink ribbon 12, paper 11 and platen 10.

Associated with each printing hammer 13 is an electromagnet 19 and an armature 18, introduction of a printing signal to electromagnetic coil 20 causing armature 18 to rotate in counterclockwise direction around axle 21 so that end portion 18*a* of armature 18 drives printing hammer 13 in the direction indicated by the arrow 28, that is, toward platen 10.

Platen 10 is mounted on a platen spindle 29 which is connected to a mechanism (not shown) for rotating same and feeding the paper 11. Frame 25 supports guide rail 7 and axle 24 of pulley 23 which drives endless belt 5.

The rest position of hammer 13 is established by stop 17, and the rest position of armature 18 is established by stop 22.

As can be seen from FIGS. *2a* and *2b*, endless belt 5 fits in channel 101 formed in character holder 1. A boss 102 projects from the surface of character belt 5 and fits into and through opening 103 in character holder 1. Boss 102 has grooves 104 and 105 therein for receiving retainer 9 to prevent accidental separation of character holder 1 from endless belt 5. Withdrawal of retainer 9, of course, makes it possible to remove character block 1 from endless belt 5 should such course of action be desired.

Teeth 106 are formed on the inner periphery of endless belt 5. These teeth engage pulley 23 and serve for driving endless belt 5.

Figure 3:
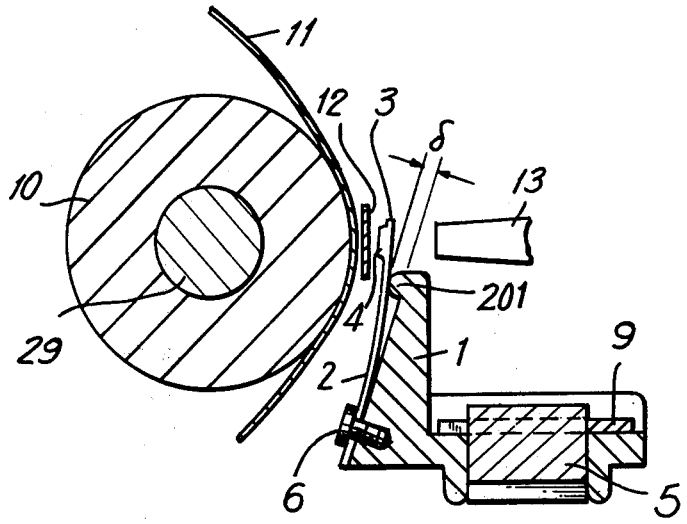
FIG. 3 is an elevational view in section and in enlarged scale of a character block and associated components in accordance with the present invention.

As shown in FIG. 3, flexible finger 3 is removably secured to character holder 1 by screw 6. Character holder 1 is provided with projection 201 which flexes finger 3 outwardly from character holder 1 and in the direction toward platen 10. The extent of the deflection indicated by the reference character $\delta$ is such that after striking the finger 3 with the printing hammer 13 the finger 3 will spring back against projection 201 and make firm contact therewith, thereby eliminating or minimizing any tendency for further vibration. Preferably, finger 201 should make contact with flexible finger 3 at a position close to but below the character 4 which is to be imprinted. The location of the projection 201 relative to character 4 and the degree of flexing which will minimize or eliminate vibration subsequent to a printing operation can readily be determined by one skilled in the art. This minimization can readily be effected to the point where any resonance or vibration subsequent to the printing operation is so small as to eliminate printing dirt or ghosts on paper 11 due to such vibration. Further, with the elimination of such vibration, it becomes possible to minimize the distance between character 4 and paper 11, thus speeding up the printing operation. An additional advantage accruing from the minimization of vibration is that adjacent fingers on the same character block are not influenced so that printing ghosts due to the vibration of adjacent fingers is prevented. Also breakage of fingers as the result of being struck by a printing hammer while still vibrating is eliminated.

Figure 4:
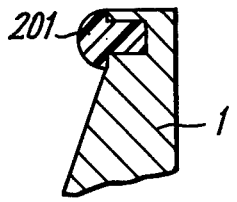
FIG. 4 is a view in section of a portion of a character block.

In a preferred embodiment, projection 201 is of a non-rigid material such as rubber or a non-rigid plastic, such an embodiment being shown in FIG. 4.

In the embodiment shown in FIGS. 1, *2a*, *2b*, 3 and 4, the character block 200 is provided with a plurality of fingers 3, each having a character 4 at the end thereof. In the preferred embodiment shown in FIGS. 5, *6a* and *6b*, finger portion 200 is integrally molded at an angle of about 90° with base portion 100, said finger and base portions constituting character member 300. The back side of each finger 3 is provided with a projection 201.

Retainer member 91 holds character base portion 100 removably to endless belt 5. Retainer member 91 has an upstanding portion 91 and a base portion 93 forming a dihedral angle of about 90° so that retainer member 91 in section is L-shaped. Retainer member 91 is formed at an angle such that upstanding portion 91 thereof engages projection 201 on each finger 3 and deflects each finger in a direction away from base portion 100 and toward the platen (not shown) against which printing is to be effected. Base portion 93 of retainer 91 engages endless belt 5 for holding character member 300 thereto.

In more detail, character member 300 is placed on endless belt 5 so that boss 102 of said belt protrudes through opening 103 in the base portion 100 thereof. Retainer member 91 is then pushed into position so that interior edges 94 and 95 engage with grooves 104 and 105 respectively of boss 102, thereby fastening said character block to said endless belt. Additionally, lip 96 of retainer member 91 is inserted into opening 107 in base portion 100, opening 107 and lip 96 being sized to provide a selected degree of deflection of finger 3 away from neutral (i.e., unflexed) position. In assembled condition of the character member 300 and belt 5, fingers 3 are deflected by portion 92 of retainer member 91 toward the paper and platen (not shown), the degree of deflection being identical for all fingers in a character member, thereby guaranteeing uniform excellent printing quality.

The foregoing, simple method of assembly provides for uniform alignment of the fingers and uniform spacing from the paper and platen against which printing is to be carried out. Furthermore, the engagement of the retainer with the projection on the fingers substantially eliminates the effect of external vibration so that dirt and ghosting are avoided. Moreover, the form of the retainer is such that it can be produced by a simple press operation.

FIGS. *6a* and *6b* show further detail in the construction of fingers 3 in the preferred embodiment of FIG. 5. The fingers 3 are of a flexible, elastic synthetic plastic or of a flexible, elastic rubber, while the characters 4 are of a hard, long-wearing metal. During the process of injection-molding the character block 200, the characters 4 are inserted and the character block and the characters 4 are made as a monolithic molding.

The apparatus of the present invention is particularly advantageous with respect to printing speed and with respect to the fact that any defect in a finger or in a block can readily be eliminated due to the fact that the character holders and the individual fingers can easily be removed from the belt and replaced. Consequently, not only is printing speed increased, but the danger of breakage is decreased and the overall cost of operation is likewise decreased.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A line-printer character belt, comprising (a) an endless belt having teeth on the inner surface thereof for engaging with toothed driving means and a boss on the outer surface thereof;

(b) an injection-molded character member attached to said belt and including a base portion and a finger portion making a dihedral angle of about 90° with each other, said base portion having an opening therein for receiving said boss, said finger portion including a plurality of flexible fingers each having a tip end and a character insert of hard, long-wearing metal in said tip end disposed outwardly from said base portion and a projection disposed inwardly toward said base portion;

(c) a retaining member having first and second segments making a dihedral angle, said retaining member being constructed and arranged for engaging said first segment thereof with said boss for holding said character member removably to said belt and for deflecting with its second segment said fingers uniformly outwardly from said base portion through engagement with said projection on each of said fingers, said engagement of said retainer member with each of said projections assuring uniform alignment of said fingers and the molded-in character insert therein, assuring controlled spacing between said fingers and the substrate on which printing is to be effected and providing for rapid damping of any vibration ensuing on a printing operation.

2. The line printer character belt, as defined in claim 1, wherein said boss has grooves therein and said first segment of said retaining member has internal edges defining a slot, said internal edges being constructed and arranged for engaging said grooves in said boss for holding said character member removably to said endless belt.

3. The line printer character belt, as defined in claim 1, wherein said base portion of said character member has a second opening therein and said first segment of said retainer member has a lip disposed and arranged for entering said second opening and for thereby establishing a desired degree of deflection of said fingers by engagement of said second segment of said retainer member with said projections on said fingers.

4. The line printer character belt, as defined in claim 1, wherein said character member is constructed of a member of the group consisting of flexible, elastic synthetic resins and flexible, elastic rubber.

5. The line printer character belt, as defined in claim 4, wherein said character member is constructed of flexible, elastic synthetic resin.

* * * * *